US007734462B2

(12) United States Patent
Kabal et al.

(10) Patent No.: US 7,734,462 B2
(45) Date of Patent: Jun. 8, 2010

(54) METHOD AND APPARATUS FOR EXTENDING THE BANDWIDTH OF A SPEECH SIGNAL

(75) Inventors: Peter Kabal, Montreal (CA); Rafi Rabipour, Côte St-Luc (CA); Yasheng Qian, Verdun (CA)

(73) Assignee: Nortel Networks Limited, St-Laurent, Quebec (CA)

( * ) Notice: Subject to any disclaimer, the term of this patent is extended or adjusted under 35 U.S.C. 154(b) by 823 days.

(21) Appl. No.: 11/469,705

(22) Filed: Sep. 1, 2006

(65) Prior Publication Data

US 2007/0067163 A1 Mar. 22, 2007

(51) Int. Cl.
*G10L 21/00* (2006.01)

(52) U.S. Cl. ..... 704/201; 704/219; 704/220; 375/240.11

(58) Field of Classification Search ..... 704/201, 704/219, 220; 375/240.11
See application file for complete search history.

(56) References Cited

U.S. PATENT DOCUMENTS 5,592,131 A * 1/1997 Labreche et al. ..... 332/103
6,389,059 B1 * 5/2002 Smith et al. ..... 375/141
6,889,182 B2 5/2005 Gustafsson
6,988,066 B2 1/2006 Malah
2002/0128839 A1 9/2002 Lindgren et al.
2003/0009327 A1 1/2003 Nilsson et al.
2003/0093279 A1 * 5/2003 Malah et al. ..... 704/265
2005/0187759 A1 * 8/2005 Malah et al. ..... 704/200
2006/0277038 A1 * 12/2006 Vos et al. ..... 704/219

OTHER PUBLICATIONS

Qian, Yasheng et al., Combining Equalization and Estimation for Bandwidth Extension of Narrowband Speech, Proc. IEEE Int. Conf. Acoustics, pp. I-713-I-716, May 2004.

* cited by examiner

*Primary Examiner*—Daniel D Abebe

(57) ABSTRACT

A bandwidth extension module, and an associated method and computer-readable medium, suitable for use in artificially extending the bandwidth of a lowband speech signal. The bandwidth extension module comprises a band-pass filter configured to produce a band-pass signal from the lowband speech signal; at least one carrier frequency modulator, each carrier frequency modulator configured to pitch-synchronously modulate the band-pass signal about a respective carrier frequency, the at least one carrier frequency modulator collectively producing a highband speech signal component; a synthesis filter configured to determine a highband speech signal based on the highband speech signal component; and a summation module configured to combine the lowband speech signal with the highband speech signal to obtain a bandwidth-extended speech signal.

69 Claims, 8 Drawing Sheets

METHOD AND APPARATUS FOR EXTENDING THE BANDWIDTH OF A SPEECH SIGNAL

FIELD OF THE INVENTION

The present invention relates generally to speech signal processing and, more particularly, to a method and apparatus for enhancing the perceived quality of a speech signal by artificially extending the bandwidth of the speech signal.

BACKGROUND OF THE INVENTION

Telephone speech transmitted in public wireline and wireless telephone networks is band-limited to 300-3400 Hz. The upper boundary is specified in order to reduce the bandwidth requirements for digitization at 8 kilosamples per second, while retaining sufficient intelligibility, though sacrificing naturalness. In particular, the absence of components in the range above 3400 Hz leads to muffled sounds. This renders it difficult to distinguish between unvoiced phonemes (e.g., /s/ and /f/), whose differentiating components are largely to be found in the missing highband range.

With the rapid evolution of telecommunications technology, devices capable of generating and processing wideband speech (hereinafter, "wideband-capable devices") have been developed. Wideband speech refers to speech having a large bandwidth (e.g., up to 7000 Hz), which has the advantage of yielding high perceived voice quality. As wideband capable devices enter the marketplace, voice communications increasingly tend to involve such wideband-capable devices. While this allows for very high quality speech communication over private, high-bandwidth networks, the wideband capabilities of wideband-capable devices are largely wasted when the communication involves a public telephone network, since the speech transmitted in such networks is quite severely band-limited.

Nevertheless, the perceived speech quality at a wideband-capable device may be improved by enhancing the band-limited speech with artificially generated spectral content in the highband range. Based on a classical speech production model, artificial generation of the spectral content in the highband range comprises determining certain highband spectral parameters and a highband excitation signal. The highband excitation signal is passed through a linear prediction synthesis filter defined by the highband spectral parameters in order to generate the spectral content in the highband range. The combination of the artificially generated spectral content and the band-limited speech results in semi-artificial wideband speech. The wideband speech so created is considered to be of high quality when it sounds, perceptually, as if it had been issued directly from the source.

Two existing methods of generating the aforesaid highband excitation signal include (i) spectral-folding techniques and (ii) full-wave rectification of prediction residuals. However, these techniques tend to produce unsatisfactory results. For example, it has been found that the use of certain prior art techniques for generating the highband excitation signal cause artifacts in the resulting wideband speech when the band-limited speech contains nasal phonemes (e.g./n/, /m/).

Against this background, there is a need in the industry for an improved technique of extending the bandwidth of a speech signal.

SUMMARY OF THE INVENTION

A first broad aspect of the present invention seeks to provide a method of artificially extending the bandwidth of a lowband speech signal. The method comprises band-pass filtering the lowband speech signal to obtain a band-pass signal; pitch-synchronously modulating said band-pass signal about at least one carrier frequency to obtain a highband speech signal component; determining a highband speech signal based on said highband speech signal component; and combining said lowband speech signal with said highband speech signal to obtain a bandwidth-extended speech signal.

A second broad aspect of the present invention seeks to provide a bandwidth extension module suitable for use in artificially extending the bandwidth of a lowband speech signal. The bandwidth extension module comprises means for band-pass filtering the lowband speech signal to obtain a band-pass signal; means for pitch-synchronously modulating said band-pass signal about at least one carrier frequency to obtain a highband speech signal component; means for determining a highband speech signal based on said highband speech signal component; and means for combining said lowband speech signal with said highband speech signal to obtain a bandwidth-extended speech signal.

A third broad aspect of the present invention seeks to provide a computer-readable medium comprising computer-readable program code which, when interpreted by a computing apparatus, causes the computing apparatus to execute a method of artificially extending the bandwidth of a lowband speech signal. The computer-readable program code comprises first computer-readable program code for causing the computing apparatus to obtain a band-pass signal by band-pass filtering the lowband speech signal; second computer-readable program code for causing the computing apparatus to obtain a highband speech signal component by pitch-synchronously modulating said band-pass signal about at least one carrier frequency; third computer-readable program code for causing the computing apparatus to determine a highband speech signal based on said highband speech signal component; and fourth computer-readable program code for causing the computing apparatus to obtain a bandwidth-extended speech signal by combining said lowband speech signal with said highband speech signal.

A fourth broad aspect of the present invention seeks to provide a bandwidth extension module suitable for use in artificially extending the bandwidth of a lowband speech signal. The bandwidth extension module comprises a band-pass filter configured to produce a band-pass signal from the lowband speech signal; at least one carrier frequency modulator, each said carrier frequency modulator configured to pitch-synchronously modulate said band-pass signal about a respective carrier frequency, the at least one carrier frequency modulator collectively producing a highband speech signal component; a synthesis filter configured to determine a highband speech signal based on said highband speech signal component; and a summation module configured to combine said lowband speech signal with said highband speech signal to obtain a bandwidth-extended speech signal.

A fifth broad aspect of the present invention seeks to provide an excitation signal generator. The excitation signal generator comprises a bandpass filter configured to produce a band-pass signal from the lowband speech signal; a modulator bank comprising a plurality of carrier frequency modulators, each of said carrier frequency modulators configured to frequency shift the band-pass signal to a respective carrier frequency associated with the respective carrier frequency modulator, thereby to produce a respective one of a plurality of modulated signals; and a summation module configured to combine the modulated signals into an excitation signal for use in generating a highband speech signal that complements the lowband speech signal in a highband frequency range. In accordance with this fifth broad aspect, the carrier frequency associated with a given one of the carrier frequency modulators is selected based on a pitch of the lowband speech signal to ensure pitch-synchronicity between the bandpass signal and the respective modulated signal produced by the given one of the carrier frequency modulators.

A sixth broad aspect of the present invention seeks to provide a bandwidth extension module. The bandwidth extension module comprises an input for receiving a first speech signal having first frequency content in a first frequency range; a processing entity; and an output for producing a second speech signal having second frequency content in a second frequency range that includes the first frequency range and an additional; frequency range outside the first frequency range. When the first frequency content contains harmonics in the first frequency range obeying a harmonic relationship, the processing entity is configured to cause the second frequency content to contain harmonics in the first frequency range and in the additional frequency range that collectively obey the same harmonic relationship.

These and other aspects and features of the present invention will now become apparent to those of ordinary skill in the art upon review of the following description of specific embodiments of the invention in conjunction with the accompanying drawings.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

Figure 1A:
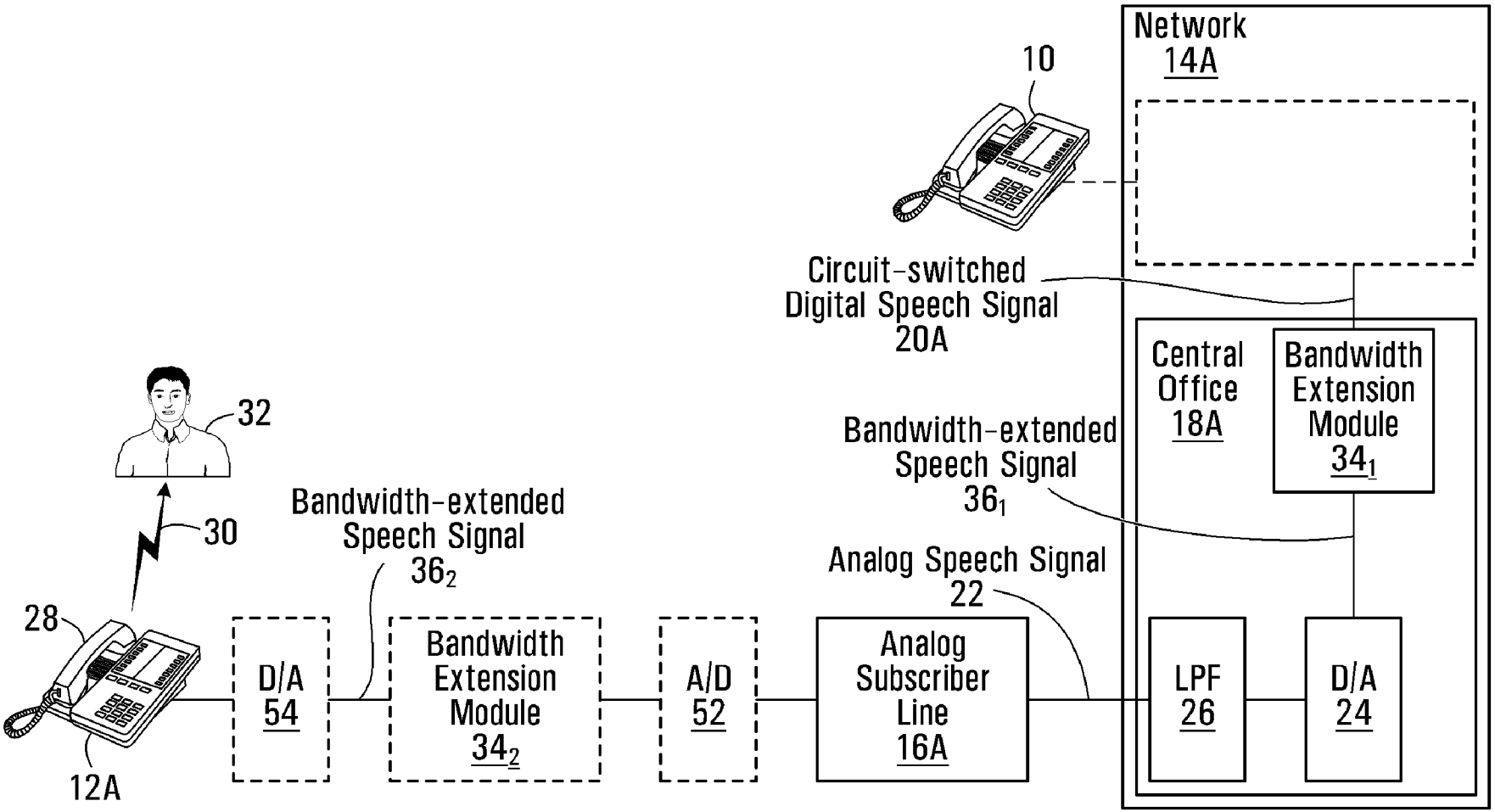
FIGS. 1A-1C depict various network scenarios that may benefit from usage of a bandwidth extension module in accordance with embodiments of the present invention.

With reference to FIG. 1A, there is shown a first non-limiting example system, in which a telephony device 10 is in communication with a telephony device 12A that is connected by an analog subscriber line 16A to a central office 18A of a telephony network 14A. In the case of FIG. 1A, the telephony device 12A is an analog wideband-capable telephony device, meaning that it has the ability to reproduce analog speech signals having frequency content in a highband range as well as lower-frequency components. By way of non-limiting example, the telephony device 12A may be a POTS phone. For the sake of simplicity, only one direction of communication is shown, namely, from the telephony device 10 to the telephony device 12A, but it should be understood that in practice, communication will tend to be bidirectional.

The central office 18A typically receives a circuit-switched digital speech signal 20A from elsewhere in the telephony network 14A. The circuit-switched digital speech signal 20A represents the outcome of a sampling process performed on an audio signal captured by a microphone (not shown) at the telephony device 10. An anti-aliasing filter (not shown) in the telephony network 14A will have ensured that the sampling process can occur at a rate of 8 kilosamples per second (ksps). Typically, such anti-aliasing filter is responsible for ensuring that the circuit-switched digital speech signal 20A is band-limited to 300-3400 Hz, and therefore it is inconsequential whether telephony device 10 is capable of generating frequency content in the highband range.

The central office 18A is responsible for converting the circuit-switched digital speech signal 20A into an analog speech signal 22 and for outputting the analog speech signal 22 onto the analog subscriber line 16A. Conversion of the circuit-switched digital speech signal 20A into the analog speech signal 22 is achieved by a digital-to-analog (D/A) converter 24 in tandem with a low-pass filter 26. At the telephony device 12A, the signal received along the analog subscriber line 16A is converted by a transponder 28 (e.g. a loudspeaker) into an audio signal 30 that is ultimately perceived by a user 32.

The present invention is useful in enhancing the perceived speech quality of the audio signal 30, where such perception is from the point of view of the user 32. Accordingly, a bandwidth extension module is provided at an appropriate point where it is desired to produce a bandwidth-extended speech signal from a band-limited speech signal. The bandwidth extension module serves to populate the highband range of the band-limited speech signal (e.g. digital speech signal 20A) with frequency content so as to improve the perceived quality of the bandwidth-extended signal. In a non-limiting example embodiment, the highband range may span the frequency range of 4000-7000 Hz, but in other embodiments the highband range may span different frequency ranges such as 3400-7000 Hz, 4000-6000 Hz, and so on. In general, the extent of the highband range is not particularly limited by the present invention.

In one specific manifestation of the first non-limiting example system shown in FIG. 1A, a bandwidth extension module (shown in solid outline at $\mathbf{34}_1$) acts on the circuit-switched digital speech signal 20A and, as such, the bandwidth extension module $\mathbf{34}_1$ may be connected in front of the D/A converter 24. The output of the bandwidth extension module $\mathbf{34}_1$ is a bandwidth-extended speech signal $\mathbf{36}_1$, which is processed by the D/A converter 24 and then by the low-pass filter 26, resulting in the analog speech signal 22. Of note is the fact that the low-pass filter 26 should be designed to have a cut-off frequency that is sufficiently high so as not to remove valuable highband components of the bandwidth-extended speech signal $\mathbf{36}_1$ generated by the bandwidth extension module $\mathbf{34}_1$. By "highband components" is meant frequency content in the highband range.

In another specific manifestation of the first non-limiting example system shown in FIG. 1A, a bandwidth extension module (shown in dashed outline at $\mathbf{34}_2$) acts on the analog speech signal 22. As such, the bandwidth extension module $\mathbf{34}_2$ may be connected in front of the telephony device 12A. This may be achieved by providing an adapter that has a first connection to a wall jack and a second connection out to the telephony device 12A; alternatively, the bandwidth extension module $\mathbf{34}_2$ may be integrated with the telephony device 12A itself. In this case, the output of the bandwidth extension module $34_2$ is a bandwidth-extended speech signal $36_2$, which is converted by the transponder 28 into the audio signal 30. It is noted that in this manifestation, the bandwidth extension module $34_2$ is preceded by an analog-to-digital input interface (shown in dashed outline at 52) and followed by a digital-to-analog output interface (shown in dashed outline at 54), to allow the bandwidth extension module $34_2$ to operate in the digital domain.

Figure 1B:
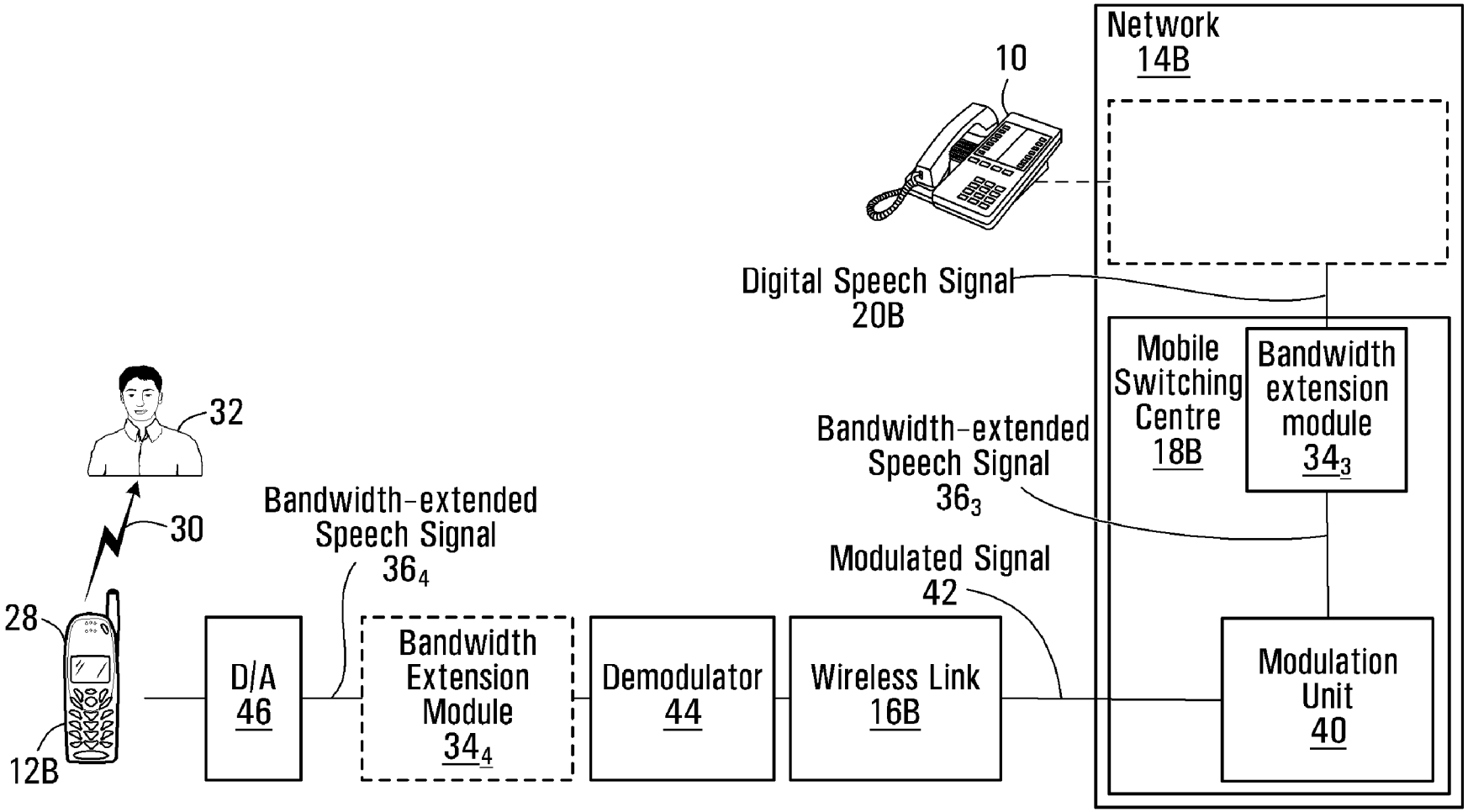

With reference to FIG. 1B, there is shown a second non-limiting example system, in which the aforesaid telephony device 10 is in communication with a mobile telephony device 12B that is connected by a wireless link 16B to a mobile switching center 18B of a telephony network 14B, possibly via one or more base stations (not shown). In the case of FIG. 1B, the mobile telephony device 12B is wideband-capable, meaning that it has the ability to process modulated wireless signals and reproduce digital speech signals carried therein, such digital speech signals having frequency content in the aforesaid highband range as well as lower-frequency components. By way of non-limiting example, the telephony device 12B may be implemented as a wireless telephone phone, a telephony-enabled wireless personal digital assistant (PDA), etc. Again, for the sake of simplicity, only one direction of communication is shown, namely, from the telephony device 10 to the mobile telephony device 12B, but it should be understood that in practice, communication will tend to be bidirectional.

The mobile switching center 18B typically receives a digital speech signal 20B from elsewhere in the telephony network 14B. The digital speech signal 20B represents the outcome of a sampling process performed on an audio signal captured by a microphone (not shown) at the telephony device 10. The mobile switching center 18B comprises a modulation unit 40 responsible for modulating the digital speech signal 20B onto a carrier and for outputting the modulated signal 42 onto the wireless link 16B. At the mobile telephony device 12B, the signal received along the wireless link 16B is demodulated by a demodulator 44, whose output is converted into analog form by a D/A converter 46 and then processed by the aforesaid transponder 28 (e.g., a loudspeaker) into the aforesaid audio signal 30 that is ultimately perceived by the user 32.

In accordance with an embodiment of the present invention, a bandwidth extension module is provided at an appropriate point where it is desired to produce a bandwidth-extended speech signal from a band-limited speech signal. The bandwidth extension module serves to populate the highband range of the band-limited speech signal (e.g. digital speech signal 20B) with frequency content so as to improve the perceived quality of the bandwidth-extended signal. As stated earlier, the highband range may span the frequency range of 4000-7000 Hz, but in other embodiments the highband range may span different frequency ranges such as 3400-7000 Hz, 4000-6000 Hz, and so on. In general, the extent of the highband range is not particularly limited by the present invention.

In one specific manifestation of the second non-limiting example system shown in FIG. 1B, a bandwidth extension module (shown in solid outline as $34_3$) acts on the digital speech signal 20B and, as such, the bandwidth extension module $34_3$ may be connected in front of the modulation unit 40. The output of the bandwidth extension module $34_3$ is a bandwidth-extended speech signal $36_3$, which is modulated by the modulation unit 40, resulting in the modulated signal 42. Of note is the fact that the wireless link 16B should be designed to allow the transmission of higher-bandwidth signals at a given carrier frequency.

In another specific manifestation of the second non-limiting example system shown in FIG. 1B, a bandwidth extension module (shown in dashed outline at $34_4$) acts on the output of the demodulator 44 at the telephony device 12B, prior to the D/A converter 46. In this case, the output of the bandwidth extension module $34_4$ is a bandwidth-extended speech signal $36_4$, which is converted by the transponder 28 into the audio signal 30.

Figure 1C:
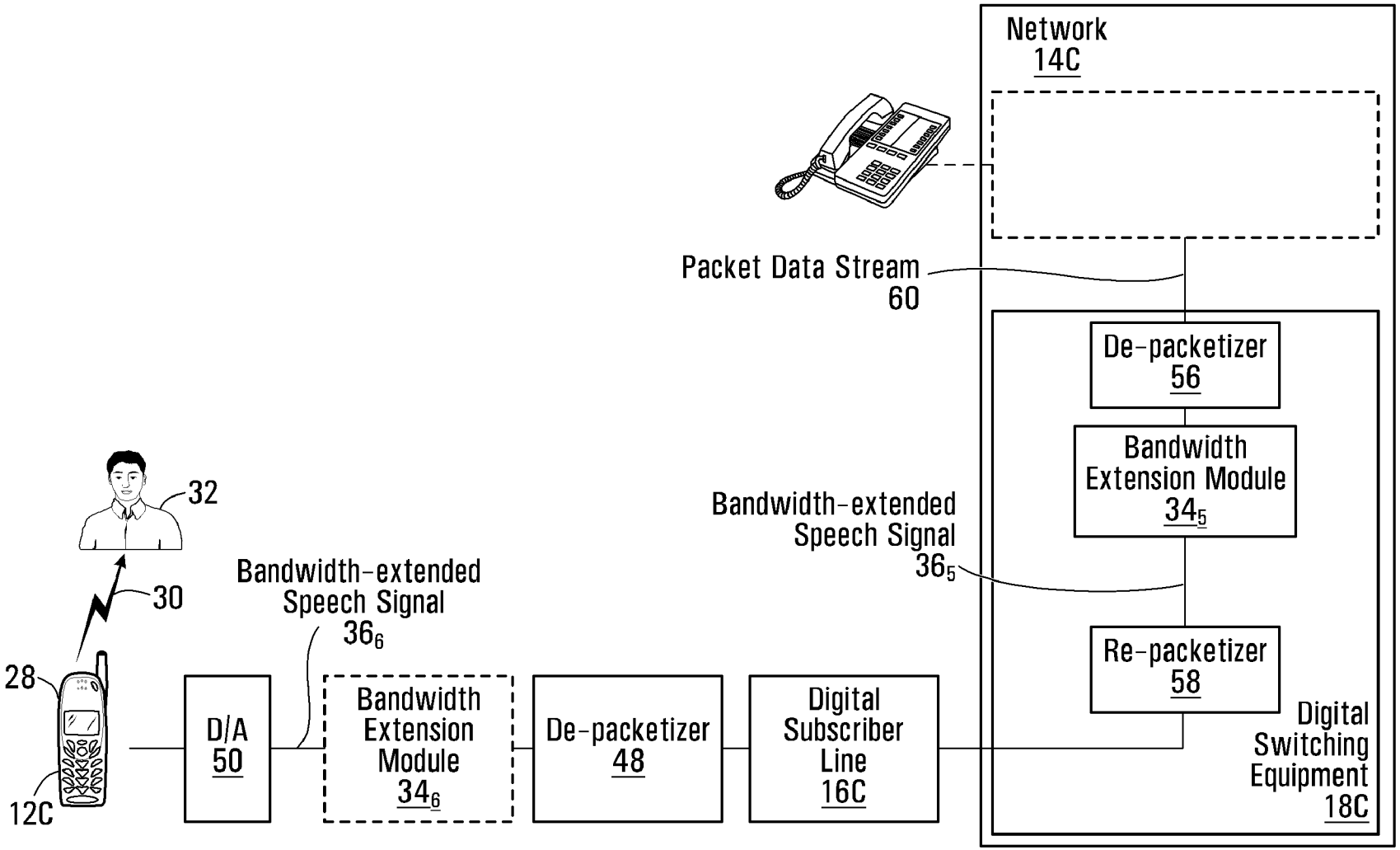

With reference to FIG. 1C, there is shown a third non-limiting example system, in which the aforesaid telephony device 10 in communication with a telephony device 12C that is connected by a digital subscriber line 16C to digital switching equipment 18C of a telephony network 14C. In the case of FIG. 1C, the telephony device 12C is a digital wideband-capable telephony device, meaning that it has the ability to process packets (e.g., IP packets transmitted over a LAN or over a public data network such as the Internet) and reproduce a digital speech signal carried therein, such digital speech signals having frequency content in the aforesaid highband range as well as lower-frequency components. By way of non-limiting example, the telephony device 12C may be implemented as a Voice-over-IP phone (where the digital subscriber line 16C is a LAN connection) or a computer executing a telephony software application (where the digital subscriber line 16C is an xDSL connection providing Internet connectivity via an xDSL modem at the customer premises). Once again, for the sake of simplicity, only one direction of communication is shown, namely, from the telephony device 10 to the telephony device 12C, but it should be understood that in practice, communication will tend to be bidirectional.

The digital switching equipment 18C typically receives from elsewhere in the packet-switched network 14C a packet data stream 60 that carries a digital speech signal. The digital speech signal carried in the packet data stream 60 represents the outcome of a sampling process performed on an audio signal captured by a microphone (not shown) at the telephony device 10. The digital switching equipment 18C is responsible for ensuring delivery of the packet data stream 60 to the telephony device 12C over the digital subscriber line 16C. Suitable hardware, software and/or control logic may be provided in the digital switching equipment 18C for this purpose. At the telephony device 12C, the signal received along the digital subscriber line 16C is extracted from the packet data stream 60 by a de-packetizer 48, converted into analog form by a D/A converter 50 and then processed by the aforesaid transponder 28 (e.g., a loudspeaker) into the aforesaid audio signal 30 that is ultimately perceived by the user 32.

In accordance with an embodiment of the present invention, a bandwidth extension module is provided at an appropriate point where it is desired to produce a bandwidth-extended speech signal from a band-limited speech signal. The bandwidth extension module serves to populate the highband range of the band-limited speech signal (e.g. contained in the packet data stream 60) with frequency content so as to improve the perceived quality of the bandwidth-extended signal. As mentioned above, the highband range may span the frequency range of 4000-7000 Hz, but in other embodiments the highband range may span different frequency ranges such as 3400-7000 Hz, 4000-8000 Hz, and so on. In general, the extent of the highband range is not particularly limited by the present invention.

In one specific manifestation of the third non-limiting example system shown in FIG. 1C, a bandwidth extension module (shown in solid outline at $34_5$) acts on the digital speech signal carried in the packet data stream 60. It is noted that in this embodiment, the bandwidth extension module $34_5$ is preceded by a de-packetizer input interface 56 and followed by a re-packetizer output interface 58, to allow the bandwidth extension module $\mathbf{34}_5$ to extract the digital speech signal, denoted 20C, that is carried in the packet data stream 60.

In another specific manifestation of the third non-limiting example system shown in FIG. 1C, a bandwidth extension module (shown in dashed outline at $\mathbf{34}_6$) acts on the output of the de-packetizer 48 at the telephony device 12C, prior to the D/A converter 50. In this case, the output of the bandwidth extension module $\mathbf{34}_6$ is a bandwidth-extended speech signal $\mathbf{36}_6$, which is converted by the transponder 28 into the audio signal 30.

Figure 2:
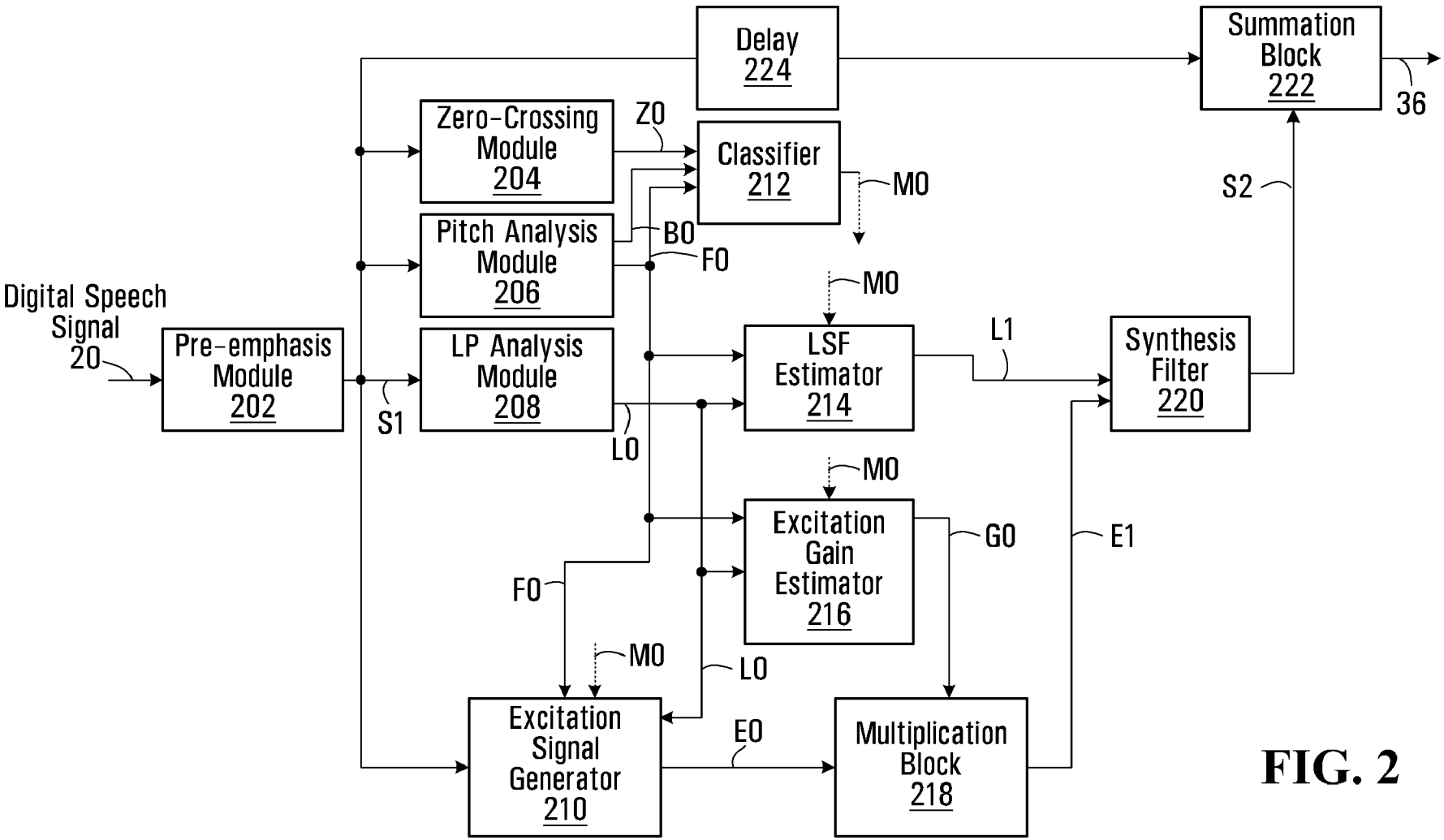
FIG. 2 shows various functional components of a bandwidth extension module of any of FIGS. 1A-1C, including an excitation signal generator, in accordance with an embodiment of the present invention.

For ease of reference, the bandwidth extension module $\mathbf{34}_1$, $\mathbf{34}_2$, $\mathbf{34}_3$, $\mathbf{34}_4$, $\mathbf{34}_5$, $\mathbf{34}_6$ is referred to hereinafter by the single reference numeral 34, and the bandwidth-extended speech signal $\mathbf{36}_1$, $\mathbf{36}_2$, $\mathbf{36}_3$, $\mathbf{36}_4$, $\mathbf{36}_5$, $\mathbf{36}_6$ is referred to hereinafter by the single reference numeral 36. In addition, the digital speech signal 20A, 20B, 20C is referred to hereinafter by the single reference numeral 20. FIG. 2 shows functional components of the bandwidth extension module 34, which is configured to process the digital speech signal 20 and to produce the bandwidth-extended speech signal 36 as a result of this processing. The various functional components of the bandwidth extension module 34, which may be implemented in hardware, software and/or control logic, as desired, are now described in further detail.

With reference therefore to FIG. 2, therefore, a pre-emphasis module 202 produces frames of a signal S1 from frames of the digital speech signal 20. It should be noted that the presence of the pre-emphasis module 202 is not required, but may be beneficial in some circumstances. The functionality of the pre-emphasis module 202, which is optional, is to recover speech content in an intermediate frequency band, based on the digital speech signal 20. For details about the design of a suitable non-limiting example of the pre-emphasis module 202, the reader is referred to Y. Qian and P. Kabal, "Combining Equalization And Estimation For Bandwidth Extension Of Narrowband Speech", *Proc. IEEE Int. Conf. Acoustics, Speech, Signal Processing* (Montreal, Canada), pp. I-713 to I-716, May 2004. This document is hereby incorporated by reference herein.

Of course, if one chooses to employ the pre-emphasis module 202, one is free to select the intermediate frequency band in which one desires to recover speech content, and this intermediate frequency band may be dependent on the bandwidth of the digital speech signal. In a specific non-limiting example, assume that the digital speech signal 20 is band-limited to 300-3400 Hz. This does not mean that there is no signal strength outside this range, but rather that the signal strength is significantly suppressed. Thus, there may be some recoverable signal content in the range below 300 Hz and some recoverable signal content in the range above 3400 Hz. Assume for the moment that one wishes to perform a preliminary expansion of the frequency content to, say, 4000 Hz before performing linear predictive analysis and other functions. To this end, the pre-emphasis module 202 may consist of an interpolator (comprising an upsampler producing samples at, say, 16 kHz, followed by a low-pass filter having a steep response at 4000 Hz and significant attenuation at, say, 4800 Hz), combined with a spectral shaping filter.

Figure 5A:
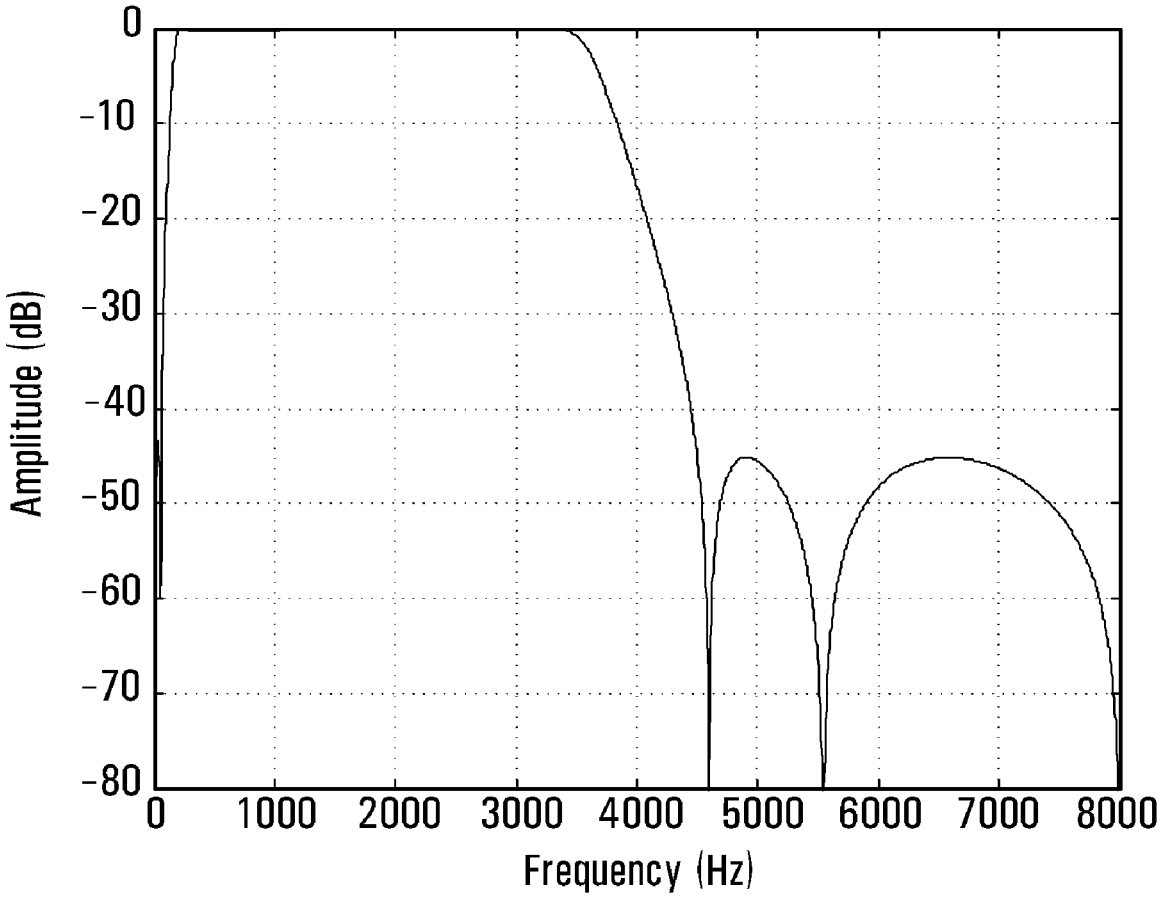
FIG. 5A shows an example frequency response of an particular type of anti-aliasing filter.
Figure 5B:
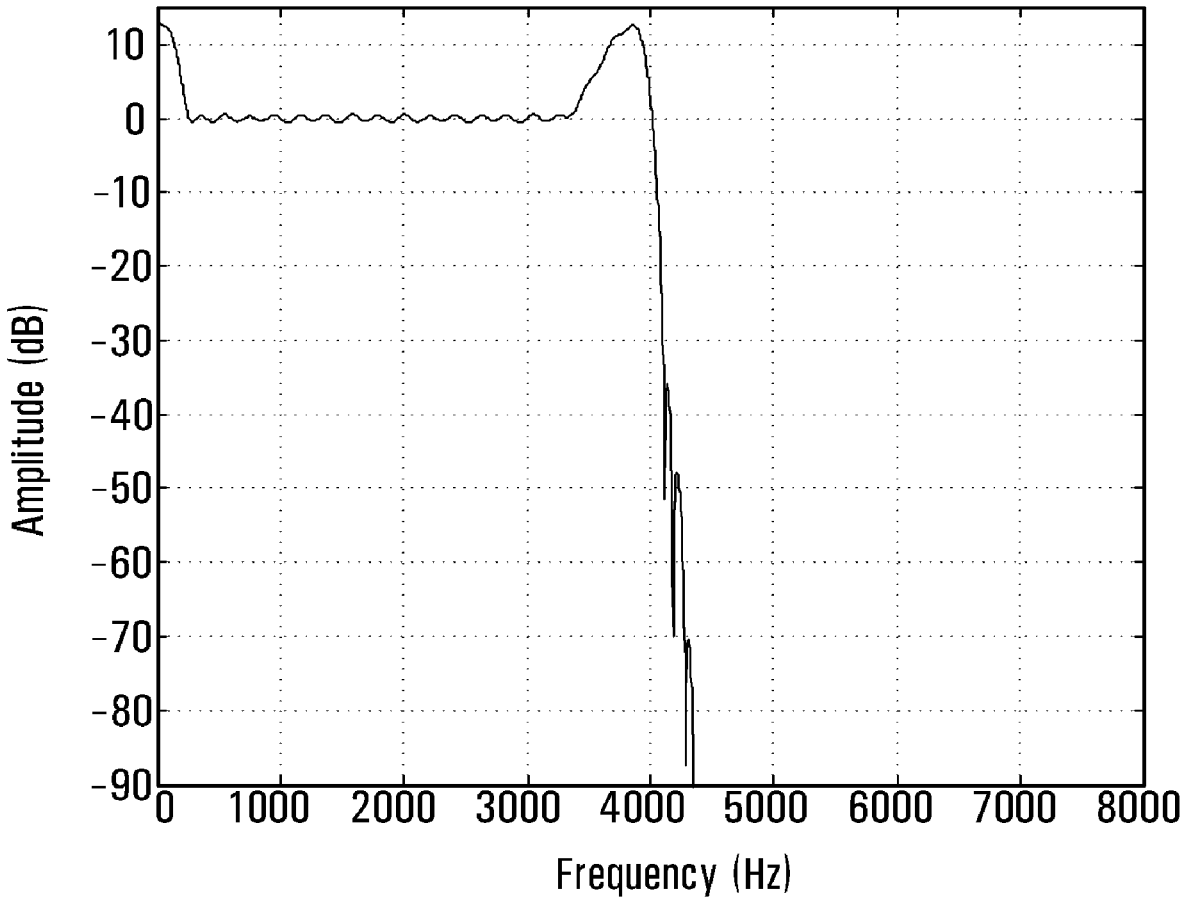
FIG. 5B shows the inverse of the frequency response of FIG. 5A.

One potential benefit of using the spectral shaping filter in the pre-emphasis module 202 is to reverse the effect, in the intermediate frequency band (in this case 3400-4000 Hz), of an anti-aliasing filter that was thought to have been used in the network 14A, 14B, 14C to band-limit the digital speech signal 20. In the case where the anti-aliasing filter used in the network 14A, 14B, 14C was known to be an ITU-T G.712 channel filer (whose frequency response is shown in FIG. 5A), the frequency response of the spectral shaping filter in the pre-emphasis module 202 may resemble that shown in FIG. 5B. Further non-limiting examples of anti-aliasing filters that may be used include ITU-T P.48 and ITU-T P.830, and the existence of yet others will be apparent to those skilled in the art. It should be understood, however, that one is generally free to select the shape of the spectral shaping filter used in the pre-emphasis module 202 to meet specific operational goals, which may be different from seeking to compensate for a specific type of anti-aliasing filter.

In addition, the spectral shaping filter in the pre-emphasis module 202 may also be used to perform equalization of the low frequency content of the digital speech signal 200, e.g., in the range from 100 Hz to 300 Hz. This is manifested in FIGS. 5A and 5B as a "bump" at low frequencies. It should also be understood that the shape of the spectral shaping filter in the pre-emphasis module 202, rather than being predetermined, may be determined adaptively to match the characteristics of the aforesaid anti-aliasing filter in the network 14A, 14B, 14C.

Those skilled in the art will appreciate that the pre-emphasis module 202 may be preceded by a speech decompression module (not shown) in order to transform mu-law or A-law coded PCM samples into 16-bit PCM samples or raw sampled speech. In this way, the speech processing functions are executed on raw data rather than compressed data. It will also be appreciated that such a decompression module may be useful even in the absence of the pre-emphasis module 202.

Continuing to refer to FIG. 2, the output of the pre-emphasis module 202, i.e., signal S1, is fed to a zero-crossing module 204, to a pitch analysis module 206, to a linear predictive analysis module 208 and to an excitation signal generator 210. The zero crossing module 204 produces a zero crossing result, denoted Z0, while the pitch analysis module 206 produces a fundamental frequency, denoted F0, and a pitch prediction gain, denoted B0. The pitch prediction gain B0 is defined as a prediction coefficient which gives a minimum mean square error between a frame of input speech and a frame of past pitch-delayed values weighted by the pitch prediction coefficient B0.

The zero crossing result Z0, the fundamental frequency F0 and the pitch prediction gain B0 are fed to a classifier 212, which produces a mode indicator M0 for each frame of the signal S1. The mode indicator M0 is indicative of whether the current frame of the signal S1 (and therefore, the current frame of the digital speech signal 20) is in one or another of several modes that may include strong harmonic mode, unvoiced mode and/or mixed mode. For example, if the pitch prediction gain B0 is larger than a certain threshold, and the fundamental frequency F0 is less than another threshold, then the classifier 212 may conclude that the current frame of the signal S1 is in the strong harmonic mode. If the pitch prediction gain B0 is less than yet another threshold, the classifier 212 may conclude that the current frame of the signal S1 is in the unvoiced mode. If neither conclusion has been reached, the classifier 212 may conclude that the current frame of the signal S1 is in the mixed mode. Of course, other modes are conceivable, and the present invention does not particularly constrain the characteristics of individual modes or the total number of possible modes. Furthermore, different classification schemes and algorithms can be used, depending on operational requirements, and without departing from the spirit of the invention.

The linear predictive (LP) analysis module 208, which can be a conventional functional module, calculates linear prediction coefficients (LPC) of each frame of the signal S1. Clearly, these LPCs will characterize the frequency content in a lower-frequency portion of the spectrum of the signal S1 which, it is recalled, is missing frequency content in the highband range. For ease of reference, and in contrast to the expression "highband range", the lower-frequency portion of the spectrum of the signal S1 will hereinafter be referred to as a "lowband range". In a non-limiting example, where the highband range extends from 4000 Hz to 7000 Hz, the lowband range may extend from 300 Hz to 4000 Hz. However, the present invention does not particularly constrain the demarcation point between the lowband range and the highband range.

In an example, fourteen (14) LPCs may be used to characterize the frequency content of the signal S1 in the lowband range. The LP analysis module 208 further converts these fourteen (14) LPCs to a corresponding number of lowband line spectrum frequencies (LSFs), denoted L0. The lowband linear spectrum frequencies L0 are provided to the excitation signal generator 210, to an LSF estimator 214 and to an excitation gain estimator 216. It should be understood that the present invention does not particularly limit the number of LPCs that need to be generated by the LP analysis module 208, and therefore persons skilled in the art should appreciate that a greater or smaller number of LPCs may be adequate or appropriate, depending on such factors as the extent of the lowband frequency range and others.

Figure 3:
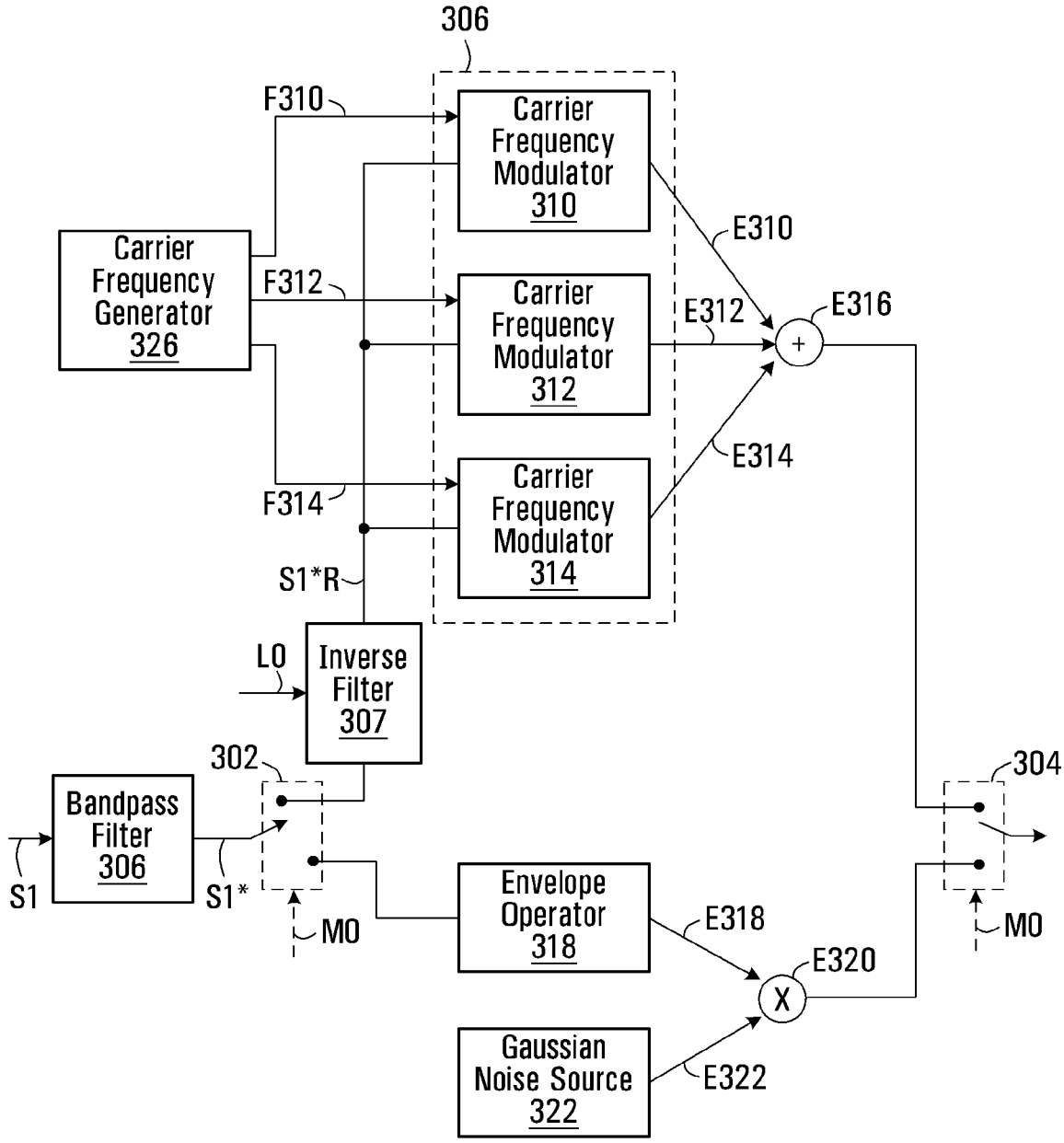
FIG. 3 shows details of the excitation signal generator of FIG. 2, in accordance with an embodiment of the present invention.

The excitation signal generator 210 produces a highband excitation signal, denoted E0, based on the signal S1, the fundamental frequency F0 and the lowband linear spectrum frequencies L0. The excitation signal generator 210 is now described in greater detail with reference to FIG. 3. Firstly, it is noted that the excitation signal generator 210 comprises a bandpass filter 306 that filters the signal S1 around a passband to produce a bandpass filtered signal S1*. In addition, it is noted that the excitation signal generator 210 is capable of selectably operating in one of two potential operational states. Entry into one of the two operational states is implemented by a selector, which is in this case symbolized by a pair of switches 302, 304 located at the output of the bandpass filter 306 and at the output of the excitation signal generator 210, respectively. Of course, the actual implementation of the selector may vary from one embodiment to another, and may involve various combinations of hardware, software and/or control logic. Such variations would be understood by persons skilled in the art and therefore require no further expansion here.

The first operational state is entered in response to the mode indicator M0 being indicative of a strong harmonic mode. In this first operational state, the bandpass filtered signal S1* feeds an inverse filter 307, whose coefficients are the lowband linear spectrum frequencies L0 from the LP analysis module 208. The effect of the inverse filter 307 is to flatten the spectrum of the bandpass filtered signal S1*, thereby to produce a residual signal denoted S1*R. Such flattening may be effected by designing the inverse filter to compensate for amplitude variations that are characterized by the lowband linear spectrum frequencies L0.

The residual signal S1*R is passed to a modulator bank 308. The modulator bank 308 comprises a parallel arrangement of one or more carrier frequency modulators; in the illustrated non-limiting embodiment, the modulator bank 308 comprises three carrier frequency modulators 310, 312, 314. Each of the carrier frequency modulators 310, 312, 314 is associated with a respective carrier frequency $F_{310}$, $F_{312}$, $F_{314}$ received from a carrier frequency selection module 326. If only one carrier frequency modulator is used, then that carrier frequency modulator produces an output that is the highband excitation signal E0 at the output of the switch 304. On the other hand, if more than one carrier frequency modulator is used, the outputs of the plural carrier frequency modulators are combined into the highband excitation signal E0. In the illustrated non-limiting embodiment, the outputs of the three carrier frequency modulators 310, 312, 314 (referred to as "modulated signals" and denoted $E_{310}$, $E_{312}$, $E_{314}$, respectively) are combined at a summation block 316 to yield the highband excitation signal E0.

As will be appreciated, each of the carrier frequency modulators 310, 312, 314 in the modulator bank 308 is operable to frequency shift the residual signal S1*R to around the respective carrier frequency $F_{310}$, $F_{312}$, $F_{314}$ received from the carrier frequency selection module 326. The bandwidth and center frequency of the bandpass filter 306 are related to the portion of the frequency content of the signal S1 from which valuable information will be extracted for the purposes of replication in the highband range. For example, if the signal S1 contains frequency content up to 4000 Hz (e.g. when the pre-emphasis module 202 is used), then certain frequency content in the range extending from 3000 Hz to 4000 Hz may contain valuable information. As such, in a non-limiting example embodiment, the bandpass filter 306 may have a bandwidth of 1000 Hz centered around a frequency of 3500 Hz. However, it should be understood that the present invention does particularly limit the bandwidth or center frequency of the bandpass filter 306.

In particular, the properties/configuration of the modulator bank 308 may be adjusted to match the user's preferences. For instance, the upper limit of bandwidth extension achieved by an embodiment of the present invention may be selectable by the user.

The number of carrier frequency modulators and their respective carrier frequencies are a function of the bandwidth of the bandpass filter 306, as well as the bandwidth of the highband frequency range that one wishes to artificially generate. Generally speaking, when there are N carrier frequency modulators, $N \geqq 1$, the carrier frequency of the $n^{th}$ given carrier frequency modulator, $N \geqq n \geqq 1$, is the sum of a respective nominal carrier frequency and a respective correction factor selected to ensure "pitch synchronicity". It should be mentioned that the present invention does not particularly limit the number of carrier frequency modulators to be employed, or on their nominal carrier frequencies. Nevertheless, it may be useful to consider an example, not to be considered limiting, where it is assumed that the highband frequency range that one wishes to artificially generate extends from 4000 Hz to 7000 Hz, and where it is assumed that the bandwidth of the bandpass filter is 1000 Hz. In this non-limiting example, a total of three carrier frequency modulators are required to fill the desired highband frequency range. To cover as much of the desired highband frequency range as possible with minimal artifacts, the three carrier frequency modulators 310, 312 and 314 should have respective carrier frequencies $F_{310}$, $F_{312}$ and $F_{314}$ corresponding to $4500+D_1$ Hz, $5500+D_2$ Hz and $6500+D_3$ Hz, where 4500 Hz, 5500 Hz and 6500 Hz are the "nominal carrier frequencies" of the three carrier frequency modulators 310, 312, 314, and where $D_1$, $D_2$ and $D_3$ are the "correction factors" selected to ensure pitch synchronicity.

Figure 4A:
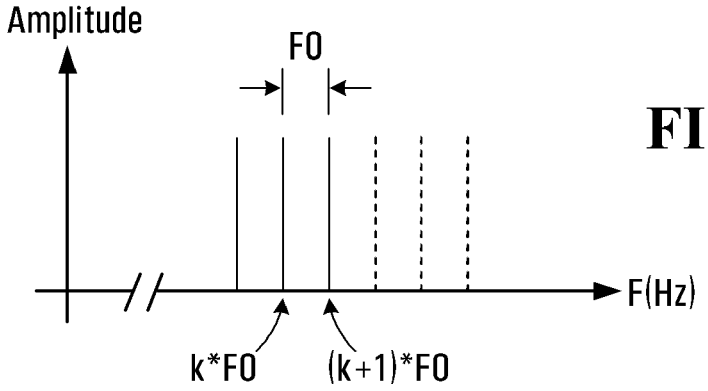
FIGS. 4A-4D illustrate the concept of pitch-synchronicity that is applicable to the excitation signal generator detailed in FIG. 3.

To better understand what is meant by "pitch synchronicity", reference is made to FIG. 4A, which shows the spectrum of the residual signal S1*R at the output of the inverse filter 307. Since what is presently being described is the excitation signal generator 210, it can be assumed that the mode indicator M0 is indicative of the signal S1 being in strong harmonic mode. Accordingly, one will notice the presence of distinct frequency components 402 (also called "harmonics") in the spectrum of the residual signal S1*R and, more particularly, in the portion of the spectrum of the residual signal S1*R corresponding to the frequency range admitted by the bandpass filter 306. The frequency components 402 obey what is known as a harmonic relationship, i.e., adjacent ones of the harmonics are separated by the fundamental frequency F0 (which was determined by the pitch analysis module 206).

One will also appreciate that for a naturally sounding signal containing harmonics both inside and outside the frequency range admitted by the bandpass filter 306, such harmonics would all obey the same harmonic relationship (i.e., adjacent ones of the harmonics are separated by the same aforesaid fundamental frequency F0). With this knowledge, it is possible to predict at which frequencies one should expect to find harmonics outside the frequency range admitted by the bandpass filter 306, and more specifically inside the frequency ranges that are occupied by the outputs of the carrier frequency modulators 310, 312, 314. Since the output of each carrier frequency modulator contains a shifted version of the residual signal S1*R whose harmonics, though frequency-shifted as a whole, remain mutually spaced by the fundamental frequency F0, one will appreciate that consistency with a naturally sounding signal can be obtained by ensuring that the frequency-shifted harmonics together with the frequency components 402 collectively obey the same harmonic relationship as the frequency components 402 obeyed on their own. This can be achieved by controlling the amount of frequency shift in order to achieve the situation where:

the lowest-frequency harmonic of the modulated signal $E_{310}$ is separated by F0 from the highest-frequency harmonic of the residual signal S1*R;

the lowest-frequency harmonic of the modulated signal $E_{312}$ is separated by F0 from the highest-frequency harmonic of the modulated signal $E_{310}$; and the lowest-frequency harmonic of the modulated signal $E_{314}$ is separated by F0 from the highest-frequency harmonic of the modulated signal $E_{312}$.

Figure 4B:
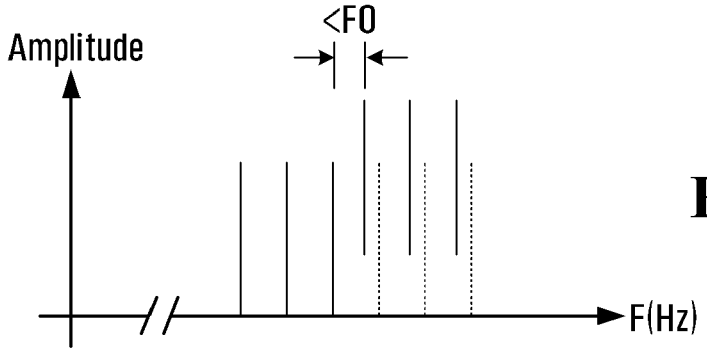
Figure 4C:
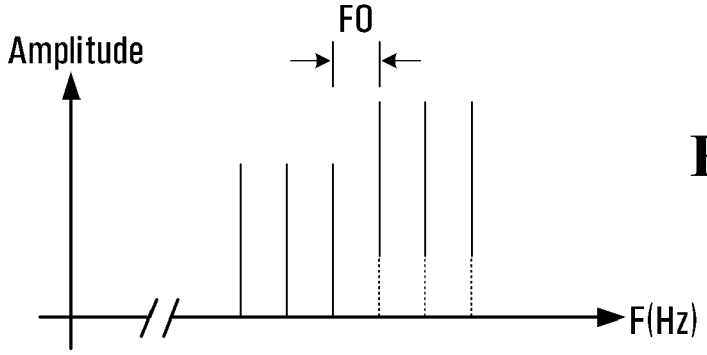
Figure 4D:
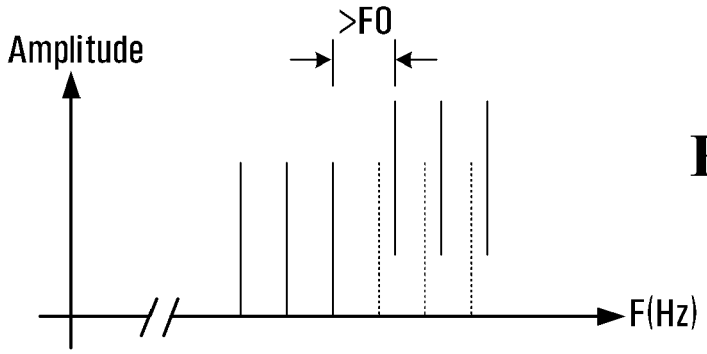

Controlling the amount of shift corresponds to adjusting the nominal carrier frequency of each carrier frequency modulator by the respective correction factor. For example, as illustrated in FIG. 4B, when the correction factor $D_{310}$ is too low, the lowest-frequency harmonic of the modulated signal $E_{310}$ will be separated by less than F0 from the highest-frequency harmonic of the residual signal S1*R. FIG. 4C shows the situation when the correction factor $D_{310}$ is correctly chosen, such that the lowest-frequency harmonic of the modulated signal $E_{310}$ will be separated by F0 from the highest-frequency harmonic of the signal residual S1*R. Finally, FIG. 4D shows the situation when the correction factor $D_{310}$ is too high, such that the lowest-frequency harmonic of the modulated signal $E_{310}$ will be separated by more than F0 from the highest-frequency harmonic of the residual signal S1*R. Thus, the correction factors determined (either implicitly or explicitly) by the carrier frequency selection module 326 are a function of the fundamental frequency F0 and the bandwidth and center frequency of the bandpass filter 306. One will note that individual correction factors are not expected to exceed the fundamental frequency F0, which typically ranges from about 65 Hz to about 400 Hz depending on the age and gender of the speaker, without being limited to this range.

Returning now to FIG. 3, the excitation signal generator 210 enters the second operational state in response to the mode indicator M0 being indicative of either of the other two modes (i.e., unvoiced mode or mixed mode). In this second operational state, the signal S1* exiting the bandpass filter 306 feeds an envelope operator 318 without passing through the inverse filter 307. The envelope operator 318 is configured to take the absolute value of the signal S1*, and the resulting envelope signal, denoted $E_{318}$, is provided to a first input of a modulator 320. A second input of the modulator 320 is provided with a noise signal $E_{322}$ emitted by, for example, a Gaussian noise generator 322 capable of producing a practical equivalent of a random variable with zero mean, unity variance and unity standard deviation. The output of the modulator 320 corresponds to the highband excitation signal E0, which is present at the output of the switch 304.

Returning now to FIG. 2, the highband excitation signal E0 is fed to a first input of a multiplication block 218. A second input of the multiplication block 218 is provided by the output of the excitation gain estimator 216, which is now described in further detail. In particular, based on the fundamental frequency F0 and the lowband linear spectrum frequencies L0, as well as on the mode indicator M0, the excitation gain estimator 216 produces a highband excitation gain, denoted G0. The highband excitation gain G0 can be defined as the square root of the energy ratio between (i) the highband components (i.e., including frequency components in the highband range that may, in a non-limiting example, extend between 4000 Hz and 7000 Hz) expected to have been present in the true wideband speech from which the signal S1 was derived and (ii) an expected artificial highband speech signal which would be produced by the excitation signal E0 from the excitation signal generator 210 is applied to a synthesis filter with a spectrum corresponding to estimated highband linear spectrum frequencies.

Various techniques can be used for producing the highband excitation gain G0. For example, one can employ three separate estimators, depending on the mode indicator M0. In a specific non-limiting example embodiment, each of the three estimators utilizes 256 entries of a respective fifteen- (15-) dimensional vector-quantized codebook, with fourteen (14) of the total number of dimensions being the lowband linear spectrum frequencies L0 (as provided by the LP analysis module 208), and the fifteenth dimension being the highband excitation gain G0. The three codebooks can be trained by a typical Generalized Lloyd-Max method, whereby each VQ codevector is the centroid of 256 cells of training data and the cells are clustered using a minimum Euclidian distance criterion. In addition to aforementioned VQ estimation methods, other statistical methods, such as Gaussian Mixture Modelling (GMM) and hidden Markov Modelling (HMM) can also be utilized to estimate the highband excitation gain G0.

The multiplication block 218 multiplies the highband excitation signal E0 by the highband excitation gain G0 to produce a scaled highband excitation signal, denoted E1, which is fed to a first input of a highband linear prediction synthesis filter 220. A second input of the highband linear prediction synthesis filter 220 is provided by the LSF estimator 214, which is now described.

The LSF estimator 214 produces a set of highband linear spectrum frequencies, denoted L1, based on the fundamental frequency F0, the lowband linear spectrum frequencies L0 and the mode indicator M0. Various techniques can be used for producing the highband linear spectrum frequencies L1. For example, one can employ three separate estimators, depending on the mode indicator M0. Each estimator could employ a known statistical method, such as vector quantization (VQ), Gaussian Mixture Model (GMM) and Hidden Markov Model (HMM). In a specific non-limiting example embodiment, each of the three estimators utilizes 256 entries of a respective twenty-four- (24-) dimensional vector-quantized codebook, with fourteen (14) of the total number of dimensions being the lowband linear spectrum frequencies L0 (as provided by the LP analysis module 208), and the remaining ten (10) dimensions being the highband spectrum linear spectrum frequencies L1. The three codebooks can be trained by a typical Generalized Lloyd-Max method, whereby each VQ codevector is the centroid of 256 cells of training data and the cells are clustered using a minimum Euclidian distance criterion.

Based on the highband linear spectrum frequencies L1 and the scaled highband excitation signal E1, the highband linear prediction synthesis filter 220 produces an artificial highband speech signal, denoted S2. In a specific non-limiting embodiment, the highband linear prediction synthesis filter 220 can be a tenth order all-pole filter, but the present invention does not particularly limit the number of poles or any other characteristic of the highband linear prediction synthesis filter 220. In the case where the highband linear prediction synthesis filter 220 is indeed a ten-pole filter, each of the ten linear predictive coefficients representing the spectrum of the artificial highband speech signal S2 is multiplied by a respective expansion factor, Gamma, to i power, where i is equal to 0, 1, . . . 10. Setting Gamma to 253/256 gives a fixed 60 Hz bandwidth expansion of each pole.

Finally, the signal S1 is delayed by a delay block 224 that is configured to have the same delay as the time it took for the artificial highband speech signal S2 to be generated from the signal S1. The artificial highband speech signal S2 and the delayed version of the signal S1 are combined together at a summation block 222 to form the bandwidth-extended speech signal 36. In an example, the bandwidth of the signal S1 will be approximately 100-4000 Hz, the bandwidth of the artificial highband signal S2 will be approximately 4000-7000 Hz, and therefore the bandwidth extended speech signal 36 will have a bandwidth of approximately 100-7000 Hz. In another example, the bandwidth of the signal S1 will be approximately 300-4000 Hz, the bandwidth of the artificial highband signal S2 will be approximately 4000-6000 Hz, and therefore the bandwidth extended speech signal 36 will have a bandwidth of approximately 300-6000 Hz. Of course, other bandwidth combinations are within the scope of the present invention.

Those skilled in the art will appreciate that the present invention does not preclude the use of additional techniques, in conjunction with those described herein, to expand other (e.g. lower-frequency) portions of the spectrum of a band-limited signal. Thus, combining the teachings of the present invention with other expansion techniques may result in added benefits.

Those skilled in the art will appreciate that in some embodiments, the functionality of the bandwidth extension module 34 may be implemented using pre-programmed hardware or firmware elements (e.g., application specific integrated circuits (ASICs), electrically erasable programmable read-only memories (EEPROMs), etc.), or other related components. In other embodiments, the functionality of the bandwidth extension module 34 may be achieved using a computing apparatus that has access to a code memory (not shown) which stores computer-readable program code for operation of the computing apparatus. The computer-readable program code could be stored on a medium which is fixed, tangible and readable directly by the bandwidth extension module 34, (e.g., removable diskette, CD-ROM, ROM, fixed disk, USB drive), or the computer-readable program code could be stored remotely but transmittable to the bandwidth extension module 34 via a modem or other interface device (e.g., a communications adapter) connected to a network (including, without limitation, the Internet) over a transmission medium. The transmission medium may be either a non-wireless medium (e.g., optical or analog communications lines) or a wireless medium (e.g., microwave, infrared or other transmission schemes) or a combination thereof.

While specific embodiments of the present invention have been described and illustrated, it will be apparent to those skilled in the art that numerous modifications and variations can be made without departing from the scope of the invention as defined in the appended claims.

The invention claimed is:

1. A method of artificially extending the bandwidth of a lowband speech signal, comprising:

band-pass filtering the lowband speech signal to obtain a band-pass signal;

pitch-synchronously modulating said band-pass signal about at least one carrier frequency to obtain a highband speech signal component;

determining a highband speech signal based on said highband speech signal component;

combining said lowband speech signal with said highband speech signal to obtain a bandwidth-extended speech signal.

2. The method defined in claim 1, further comprising:

detecting a pitch of said lowband speech signal.

3. The method defined in claim 2, further comprising:

using a pitch estimation module to detect said pitch.

4. The method defined in claim 2, wherein said step of band-pass filtering comprises utilizing a band-pass filter having a passband.

5. The method defined in claim 4, further comprising:

determining each of the at least one said carrier frequency on the basis of (i) said pitch and (ii) said passband of said band-pass filter.

6. The method defined in claim 5, wherein the at least one carrier frequency includes a plurality of carrier frequencies.

7. The method defined in claim 6, wherein pitch-synchronously modulating said band-pass signal about the at least one carrier frequency to obtain said highband speech signal component comprises pitch-synchronously modulating said band-pass signal about each of said carrier frequencies in said plurality of carrier frequencies, and combining the results to obtain said highband speech signal component.

8. The method defined in claim 7, wherein said plurality of carrier frequencies includes three carrier frequencies.

9. The method defined in claim 6, wherein each of said plurality of carrier frequencies is the sum of a respective nominal carrier frequency and a respective correction factor.

10. The method defined in claim 9, wherein said passband of said band-pass filter is between approximately 3000 Hz and approximately 4000 Hz.

11. The method defined in claim 10, wherein a first said nominal carrier frequency is approximately 4500 Hz, and wherein a second said nominal carrier frequency is approximately 5500 Hz.

12. The method defined in claim 11, wherein a third said nominal carrier frequency is approximately 6500 Hz.

13. The method defined in claim 1, further comprising:

prior to said pitch-synchronously modulating, inverse filtering said band-pass signal to flatten a spectrum of said band-pass signal.

14. The method defined in claim 1, wherein said highband speech signal component comprises an excitation signal.

15. The method defined in claim 14, further comprising:

multiplying said excitation signal by an excitation gain to obtain a scaled excitation signal.

16. The method defined in claim 15, further comprising:

determining said excitation gain based on said pitch and on a set of lowband linear spectral frequencies.

17. The method defined in claim 15, wherein said determining a highband speech signal based on said highband speech signal component comprises synthesizing said highband speech signal based on said scaled excitation signal and a set of highband linear spectral frequencies.

18. The method defined in claim 17, further comprising:

determining said highband linear spectral frequencies based on said pitch and on a set of lowband linear spectral frequencies.

19. The method defined in claim 18, further comprising:

determining said lowband linear spectral frequencies based on said lowband speech signal.

20. The method defined in claim 19, further comprising:

prior to said pitch-synchronously modulating, inverse filtering said band-pass signal to compensate for amplitude variations in a spectrum of said band-pass signal, said amplitude variations being characterized by said lowband linear spectral frequencies.

21. The method defined in claim 20, wherein said combining said lowband speech signal with said highband speech signal to obtain a bandwidth-extended speech signal comprises combining said highband speech signal with a delayed version of said lowband speech signal to obtain said bandwidth-extended speech signal.

22. The method defined in claim 1, further comprising:

pre-filtering an original speech signal to obtain said lowband speech signal, said pre-filtering causing partial extension of a frequency spectrum of said original speech signal into an intermediate frequency band.

23. The method defined in claim 22, wherein said pre-filtering comprises upsampling, low-pass filtering and spectral shaping.

24. The method defined in claim 23, wherein said intermediate frequency band extends from approximately 3400 Hz to approximately 4000 Hz.

25. The method defined in claim 22, wherein said original speech signal has no component above 3400 Hz that is not significantly attenuated and wherein said lowband speech signal has no component above 4000 Hz that is not significantly attenuated.

26. The method defined in claim 1, further comprising:

classifying said lowband speech signal as belonging to a strong harmonic mode, an unvoiced mode or a mixed mode.

27. The method defined in claim 26, wherein pitch-synchronously modulating said band-pass signal about at least one carrier frequency to obtain said highband speech signal is only performed in response to said lowband speech signal being classified as belonging to said strong harmonic mode.

28. The method defined in claim 27, further comprising multiplying an output of a noise generator with an output of an envelope operator applied to said band-pass signal to obtain said highband speech signal component in response to said lowband speech signal being classified as belonging to said unvoiced mode or said mixed mode.

29. A bandwidth extension module suitable for use in artificially extending the bandwidth of a lowband speech signal, comprising:

means for band-pass filtering the lowband speech signal to obtain a band-pass signal;

means for pitch-synchronously modulating said band-pass signal about at least one carrier frequency to obtain a highband speech signal component;

means for determining a highband speech signal based on said highband speech signal component;

means for combining said lowband speech signal with said highband speech signal to obtain a bandwidth-extended speech signal.

30. A computer-readable storage medium comprising computer-readable program code which, when interpreted by a computing apparatus, causes the computing apparatus to execute a method of artificially extending the bandwidth of a lowband speech signal, the computer-readable program code comprising:

first computer-readable program code for causing the computing apparatus to obtain a band-pass signal by band-pass filtering the lowband speech signal;

second computer-readable program code for causing the computing apparatus to obtain a highband speech signal component by pitch-synchronously modulating said band-pass signal about at least one carrier frequency;

third computer-readable program code for causing the computing apparatus to determine a highband speech signal based on said highband speech signal component;

fourth computer-readable program code for causing the computing apparatus to obtain a bandwidth-extended speech signal by combining said lowband speech signal with said highband speech signal.

31. A bandwidth extension module suitable for use in artificially extending the bandwidth of a lowband speech signal, comprising:

a band-pass filter configured to produce a band-pass signal from the lowband speech signal;

at least one carrier frequency modulator, each said carrier frequency modulator configured to pitch-synchronously modulate said band-pass signal about a respective carrier frequency, the at least one carrier frequency modulator collectively producing a highband speech signal component;

a synthesis filter configured to determine a highband speech signal based on said highband speech signal component;

a summation module configured to combine said lowband speech signal with said highband speech signal to obtain a bandwidth-extended speech signal.

32. The bandwidth extension module defined in claim 31, implemented at one of (i) a central office; (ii) a mobile switching center; and (iii) digital switching equipment.

33. The bandwidth extension module defined in claim 31, implemented in an adapter for a wideband-capable telephony device.

34. The bandwidth extension module defined in claim 31, integrated with a wideband-capable telephony device.

35. The bandwidth extension module defined in claim 31, further comprising:

a pitch estimation module configured to detect a pitch of said lowband speech signal.

36. The bandwidth extension module defined in claim 35, wherein said band-pass filter has a passband, the bandwidth extension module further comprising:

a carrier frequency generator configured to determine each respective carrier frequency on the basis of (i) said pitch and (ii) said passband of said band-pass filter.

37. The bandwidth extension module defined in claim 36, wherein the at least one carrier frequency modulator includes a plurality of carrier frequency modulators.

38. The bandwidth extension module defined in claim 37, wherein each respective carrier frequency is the sum of a respective nominal carrier frequency and a respective correction factor.

39. The bandwidth extension module defined in claim 38, wherein said passband of said band-pass filter is between approximately 3000 Hz and approximately 4000 Hz.

40. The bandwidth extension module defined in claim 39, wherein a first respective nominal carrier frequency is approximately 4500 Hz, and wherein a second respective nominal carrier frequency is approximately 5500 Hz.

41. The bandwidth extension module defined in claim 40, wherein a third respective nominal carrier frequency is approximately 6500 Hz.

42. The bandwidth extension module defined in claim 31, further comprising:

an inverse filter connected between the band-pass filter and the at least one carrier frequency modulator, said inverse filter configured to flatten a spectrum of said band-pass signal.

43. The bandwidth extension module defined in claim 31, wherein said highband speech signal component comprises an excitation signal and wherein said bandwidth extension module further comprises:

a functional element configured to multiply said excitation signal by an excitation gain to obtain a scaled excitation signal, said excitation gain being determined based on said pitch and on a set of lowband linear spectral frequencies.

44. The bandwidth extension module defined in claim 43, wherein to determine said highband speech signal based on said highband speech signal component, said synthesis utilizes said scaled excitation signal and a set of highband linear spectral frequencies, said highband linear spectral frequencies being determined based on said pitch and on a set of lowband linear spectral frequencies.

45. The bandwidth extension module defined in claim 44, further comprising:

an estimation module configured to determine said highband linear spectral frequencies based on said pitch and on a set of lowband linear spectral frequencies.

46. The bandwidth extension module defined in claim 45, further comprising:

an estimation module configured to determine said lowband linear spectral frequencies based on said lowband speech signal.

47. The bandwidth extension module defined in claim 46, further comprising:

an inverse filter connected between the band-pass filter and the at least one carrier frequency modulator, said inverse filter configured to compensate for amplitude variations in a spectrum of said band-pass signal, said amplitude variations being characterized by said lowband linear spectral frequencies.

48. The bandwidth extension module defined in claim 47, further comprising:

a delay element configured to delay said lowband speech signal prior to combining by the summation module.

49. The bandwidth extension module defined in claim 31, further comprising:

a pre-emphasis module configured to process an original speech signal to obtain said lowband speech signal, thereby to cause partial extension of a frequency spectrum of said original speech signal into an intermediate frequency band.

50. The bandwidth extension module defined in claim 49, wherein said pre-emphasis module comprises an upsampler, a low-pass filter and a spectral shaping filter.

51. The bandwidth extension module defined in claim 50, wherein said intermediate frequency band extends from approximately 3400 Hz to approximately 4000 Hz.

52. The bandwidth extension module defined in claim 49, wherein said original speech signal has no component above 3400 Hz that is not significantly attenuated and wherein said lowband speech signal has no component above 4000 Hz that is not significantly attenuated.

53. The bandwidth extension module defined in claim 31, further comprising:

a classifier configured to classify said lowband speech signal as belonging to a strong harmonic mode, an unvoiced mode or a mixed mode;

a selector connected to said classifier, and configured to allow said highband speech signal component to be produced from the at least one carrier frequency modulator only in response to said lowband speech signal being classified as belonging to said strong harmonic mode.

54. The bandwidth extension module defined in claim 53, further comprising:

a noise generator producing an output;

an envelope operator processing said band-pass signal to produce an output;

said selector further configured to cause said highband speech signal component to be produced by multiplication of the output of the noise generator with the output of the envelope operator in response to said lowband speech signal being classified as belonging to said unvoiced mode or said mixed mode.

55. An excitation signal generator, comprising:

a bandpass filter configured to produce a band-pass signal from the lowband speech signal;

a modulator bank comprising a plurality of carrier frequency modulators, each of said carrier frequency modulators configured to frequency shift the band-pass signal to a respective carrier frequency associated with the respective carrier frequency modulator, thereby to produce a respective one of a plurality of modulated signals;

a summation module configured to combine the modulated signals into an excitation signal for use in generating a highband speech signal that complements the lowband speech signal in a highband frequency range;

the carrier frequency associated with a given one of the carrier frequency modulators being selected based on a pitch of the lowband speech signal to ensure pitch-synchronicity between the bandpass signal and the respective modulated signal produced by the given one of the carrier frequency modulators.

56. The excitation signal generator defined in claim 55, further comprising:

an inverse filter connected between the band-pass filter and the modulator bank, said inverse filter configured to flatten a spectrum of said band-pass signal.

57. The excitation signal generator defined in claim 56, wherein said bandwidth extension module is configured to receive a detected pitch of said lowband speech signal, wherein said band-pass filter has a passband, the bandwidth extension module further comprising:

a carrier frequency generator configured to determine each respective carrier frequency on the basis of (i) said pitch and (ii) said passband of said band-pass filter.

58. The excitation signal generator defined in claim 57, wherein each respective carrier frequency is the sum of a respective nominal carrier frequency and a respective correction factor.

59. The excitation signal generator defined in claim 58, wherein said passband of said band-pass filter is between approximately 3000 Hz and approximately 4000 Hz.

60. The excitation signal generator defined in claim 59, wherein a first respective nominal carrier frequency is approximately 4500 Hz, and wherein a second respective nominal carrier frequency is approximately 5500 Hz.

61. The excitation signal generator defined in claim 60, wherein a third respective nominal carrier frequency is approximately 6500 Hz.

62. The excitation signal generator defined in claim 55, further comprising:

an inverse filter connected between the band-pass filter and the modulator bank, said inverse filter configured to flatten a spectrum of said band-pass signal.

63. The excitation signal generator defined in claim 55, further comprising:

a pre-emphasis module configured to process an original speech signal to obtain said lowband speech signal, thereby to cause partial extension of a frequency spectrum of said original speech signal into an intermediate frequency band.

64. The excitation signal generator defined in claim 63, wherein said pre-emphasis module comprises an upsampler, a low-pass filter and a spectral shaping filter.

65. The excitation signal generator defined in claim 64, wherein said intermediate frequency band extends from approximately 3400 Hz to approximately 4000 Hz.

66. The excitation signal generator defined in claim 63, wherein said original speech signal has no component above 3400 Hz that is not significantly attenuated and wherein said lowband speech signal has no component above 4000 Hz that is not significantly attenuated.

67. The excitation signal generator defined in claim 55, further comprising:

a classifier configured to classify said lowband speech signal as belonging to a strong harmonic mode, an unvoiced mode or a mixed mode;

a selector connected to said classifier, and configured to allow said excitation signal to be produced from the modulated signals only in response to said lowband speech signal being classified as belonging to said strong harmonic mode.

68. The excitation signal generator defined in claim 67, further comprising a noise generator producing an output;

an envelope operator processing said band-pass signal to produce an output;

said selector further configured to cause said excitation signal to be produced by multiplication of the output of the noise generator with the output of the envelope operator in response to said lowband speech signal being classified as belonging to said unvoiced mode or said mixed mode.

69. A bandwidth extension module, comprising:

an input for receiving a first speech signal having first frequency content in a first frequency range;

a processing entity comprising:

a band-pass filter configured to produce a band-pass signal from the first speech signal;

at least one carrier frequency modulator, each said carrier frequency modulator configured to pitch-synchronously modulate said band-pass signal about a respective carrier frequency, the at least one carrier frequency modulator collectively producing a highband speech signal component;

a synthesis filter configured to determine a highband speech signal based on said highband speech signal component; and a summation module configured to combine said first speech signal with said highband speech signal to obtain said second speech signal;

an output for producing a second speech signal having second frequency content in a second frequency range that includes an additional frequency range outside the first frequency range; and wherein when the first frequency content contains harmonics in the first frequency range obeying a harmonic relationship, said processing entity is configured to cause the second frequency content to contain harmonics in the first frequency range and in the additional frequency range that collectively obey said harmonic relationship.

* * * * *